US011129454B1

(12) United States Patent
Campbell et al.

(10) Patent No.: US 11,129,454 B1
(45) Date of Patent: Sep. 28, 2021

(54) ELECTRONIC ASSEMBLY FOR A COVER SUPPORTED BY A POLE

(71) Applicants: Charles Phillip Campbell, Stony Point, NC (US); David Allen Campbell, Stony Point, NC (US)

(72) Inventors: Charles Phillip Campbell, Stony Point, NC (US); David Allen Campbell, Stony Point, NC (US)

( * ) Notice: Subject to any disclaimer, the term of this patent is extended or adjusted under 35 U.S.C. 154(b) by 0 days.

(21) Appl. No.: 16/595,415

(22) Filed: Oct. 7, 2019

(51) Int. Cl.
*A45B 3/04* (2006.01)
*A45B 23/00* (2006.01)
*A45B 25/00* (2006.01)

(52) U.S. Cl.
CPC ..... *A45B 23/00* (2013.01); *A45B 3/04* (2013.01); *A45B 25/00* (2013.01); *A45B 2023/0012* (2013.01); *A45B 2023/0037* (2013.01); *A45B 2200/1009* (2013.01); *A45B 2200/1018* (2013.01); *A45B 2200/1027* (2013.01); *A45B 2200/1036* (2013.01); *A45B 2200/1054* (2013.01); *A45B 2200/1063* (2013.01)

(58) Field of Classification Search
CPC .... A45B 2200/1009; A45B 2200/1018; A45B 2200/1027; A45B 2200/1036; A45B 2200/1054
USPC ..... 135/16
See application file for complete search history.

(56) References Cited

U.S. PATENT DOCUMENTS

| | | | | |
|---|---|---|---|---|
| 1,148,332 | A * | 7/1915 | Onyskow | A45B 3/00 135/16 |
| 3,177,881 | A * | 4/1965 | Covington | A45B 3/00 135/16 |
| 3,401,874 | A * | 9/1968 | Covington | A45B 3/00 416/142 |
| 5,007,811 | A | 4/1991 | Hopkins | |
| 5,172,711 | A * | 12/1992 | Mueller | A45B 3/00 135/16 |
| 5,273,062 | A * | 12/1993 | Mozdzanowski | A45B 3/00 135/16 |
| 5,934,499 | A * | 8/1999 | van der Hoven | A45B 3/00 220/475 |
| 6,230,723 | B1 * | 5/2001 | Hixson | A45B 3/00 135/16 |
| 6,298,866 | B1 | 10/2001 | Molnar, IV | |
| 6,325,084 | B1 * | 12/2001 | Cohen | A45B 3/00 135/16 |
| 6,991,341 | B1 * | 1/2006 | Khor | A45B 3/04 362/102 |

(Continued)

*Primary Examiner* — Robert Canfield
(74) *Attorney, Agent, or Firm* — William Simmons; Simmons Patents

(57) ABSTRACT

An electronic assembly for a cover supported by a pole is disclosed. The pole defines a top portion associated with a cover and an opposing bottom portion that engages a support surface such as a floor. The electronic assembly may comprise an electronic fan defining a fan body housing a motor that rotates a hub associated with collapsible fan blades. The pole may extend through the body so that the hub rotates about an axis defined by the pole. The body may further slide up and down the pole and engage the pole at a first latch point where it stays while deployed and operating. A power source may be provided to supply the power needed to rotate the hub. A sensor may be disposed at or adjacent to the first latch point and the electronic fan may be disabled when the sensor does not sense the fan body.

13 Claims, 6 Drawing Sheets

(56) References Cited

U.S. PATENT DOCUMENTS

| | | | | |
|---|---|---|---|---|
| 7,481,547 | B2 * | 1/2009 | Li | A45B 3/00 362/102 |
| 7,562,667 | B2 | 7/2009 | Li | |
| 8,794,781 | B2 | 8/2014 | Kuelbs | |
| 10,138,894 | B1 * | 11/2018 | O'Connor | F04D 25/08 |
| 2003/0029481 | A1 * | 2/2003 | Ouyang | F04D 29/601 135/16 |
| 2003/0168091 | A1 * | 9/2003 | Cohen | F04D 25/088 135/16 |
| 2006/0124157 | A1 * | 6/2006 | Bayour | A45B 23/00 135/16 |
| 2008/0076379 | A1 * | 3/2008 | Li | A45B 3/04 455/344 |

* cited by examiner

ELECTRONIC ASSEMBLY FOR A COVER SUPPORTED BY A POLE

FIELD OF THE INVENTION

The present invention generally involves an electronic assembly for a cover supported by a pole such as an outdoor patio umbrella. Particular embodiments of the present invention may be incorporated into umbrellas such as patio umbrellas used with or without tables. Elements of the electronic assembly may automatically deploy/engage when opened and retract/disengage when closed and may include configurable modules.

BACKGROUND OF THE INVENTION

People often have a need for shade while outside, especially during the sunny and hotter seasons. Indeed, there are recorded uses of shading devices dating way back to early cave dwellers. Today there is an industry for producing what are called "patio umbrellas" which may often be used with a table. Generally speaking, a patio umbrella is an umbrella that is manufactured or created for outdoor use and usually designed to create a small shaded area where people will sit. As is well known, a shaded area is cooler and easier on the eyes. There are many types of patio umbrellas and associated accessories today that enhance cooling and provide other features.

Problems arise, however, with today's patio umbrellas related to deficiencies in the method of deployment and storage of features that may be associated with the patio umbrella. For example, while fans have been associated with patio umbrellas they (umbrellas or fans or both) are not convenient to relocate and store. Further, while some locations may need a fan to provide a cooling breeze, other locations may have plenty of wind (e.g. beach) but need other features such as shade, entertainment, secure storage, battery charging stations, and communications. Therefore, the need exists for an improved electronic fan assembly and configurable modules that may be associated with a portable umbrella product, such as a patio umbrella, that is easily deployed, collapsed and stored, and easily moveable that may be used in places without a convenient power source requiring the use of stored energy.

BRIEF DESCRIPTION OF THE INVENTION

Aspects and advantages of the invention are set forth below in the following description, or may be obvious from the description, or may be learned through practice of the invention.

One embodiment of the present invention is an electronic assembly for a cover supported by a pole such as a patio umbrella. The electronic assembly comprises an electronic fan assembly defining a fan body housing a motor configured for rotating a hub with mechanically associated fan blades. The body may be movably associated with the pole which may extend through the center of the body so that the body may slide along the pole. The pole defines a top portion associated with a cover and an opposing bottom portion configured to engage a support surface. The cover defines an outer surface configured to face a light source to be blocked (to create shade) and an opposing inner surface. The fan assembly may engage the pole at a first latching point where the hub may rotate about an axis defined by the pole. A power source, such a typical battery used to power drills, is electronically associated with the fan assembly to supply the power required by the motor to rotate the hub. A sensor may be disposed at or adjacent to the first latch point and may be configured to disable the motor/fan assembly when the sensor does not sense the presence of the body at the first latch point. The fan blades, mechanically associated with the hub at one end in a typical ceiling fan configuration, may be configured to deploy when the hub is rotating and retract when the hub is not rotating. For example, the fan blades may be configured to automatically extend when the hub is rotating at or above a predefined speed and collapse toward the bottom portion of the pole when the hub stops rotating. The predefined speed will depend on the shape and weight of the blades. That said, ideally, the blades should automatically extend when the tips of the blades are above 1000 feet per minute. Alternatively, the blades may be configured to be manually extended and collapsed. For one embodiment, a photovoltaic device is associated with the cover's outer surface or the pole's top portion so that it may receive sunlight and generate power that may be provided to the battery and/or fan assembly. The configuration of the fan blades and the speed at which the hub rotates may be selected to generate a volume of air displacement that repels insects within a predefined zone below the fan blades wherein the predefined zone defines an airflow band under the perimeter of the umbrella. This airflow band may be useful, for example, in keeping insects, (such as flies, mosquitoes, and gnats), away from people sitting in the shade created by the cover as well as provide a cooling breeze.

One alternative embodiment of the present invention is an electronic assembly for a cover supported by a pole such as a patio umbrella. For this embodiment, the electronic assembly includes an interface associated with a pole where the interface is configured to receive electronic modules. As before, the pole defines a top portion associated with a cover and an opposing bottom portion configured to engage a support surface. The cover, which may be collapsible, defines an outer surface and an opposing inner surface. The interface may be movably associated with the pole. Similarly, an electronic module may be movably associated with the pole and may releasably engage the interface. Embodiments of electronic modules include one of (a) a collapsible fan module, (b) a squirrel fan module, or (c) a personality module. The electronic assembly may further comprise a power source configured to supply power to at least one of the interface and the electronic module. For some embodiments, the power supply may be integrated into the interface.

The collapsible fan module may be configured to fit around the pole in the same way as the fan assembly described above. The collapsible fan assembly may comprise an electronic motor configured to rotate a hub about an axis defined by the pole. The hub may be mechanically associated with fan blades that extend from the hub in a direction generally perpendicular from the pole, (such as the fan blades found in a typical ceiling fan) when the hub is rotating. Conversely, the fan blades may be configured to collapse to a position more parallel to the pole when the hub is not rotating. A squire fan module has similar features to the collapsible fan module but for the fan blades—they define a squirrel fan configuration, and thus, such blades generally do not collapse when the hub is not rotating. A personality module may be considered a module that determines the "personality" of the electronic assembly as something more than an electronic fan assembly. For example, when the personality module is a secured storage module, the electronic assembly's "personality" may be one of a security system. That said, there may be a plurality of modules associated with the interface, perhaps in a stacked configuration.

A sensor may be provided for detecting when the interface is positioned at the first latch point and/or an electronic module is engaging the interface. The sensor may enable or disable the electronic module based on predefined module criteria.

As noted above, for one embodiment, the interface is movably associated with the pole and the cover defines a collapsible umbrella configured to extend and collapse. The umbrella may be mechanically associated with the interface so that the umbrella extends as the interface moves toward the top portion and collapses as the interface moves toward the bottom portion. Where the electronic module defines a collapsible fan module, such fan module may comprise a body that houses the fan components, and that may be movably associated with the pole, which extends through the body thereby defining an axis through the center of the body. The collapsible fan blades may collapse toward the bottom portion when the hub is rotating slower than a predefined speed.

The interface may further define a smart interface containing electronics that control the electronic modules in response to control signals transmitted to the interface. For example, a user may use a transmitter to wirelessly communicate with the interface to control the speed and on/off state of a collapsible fan module.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
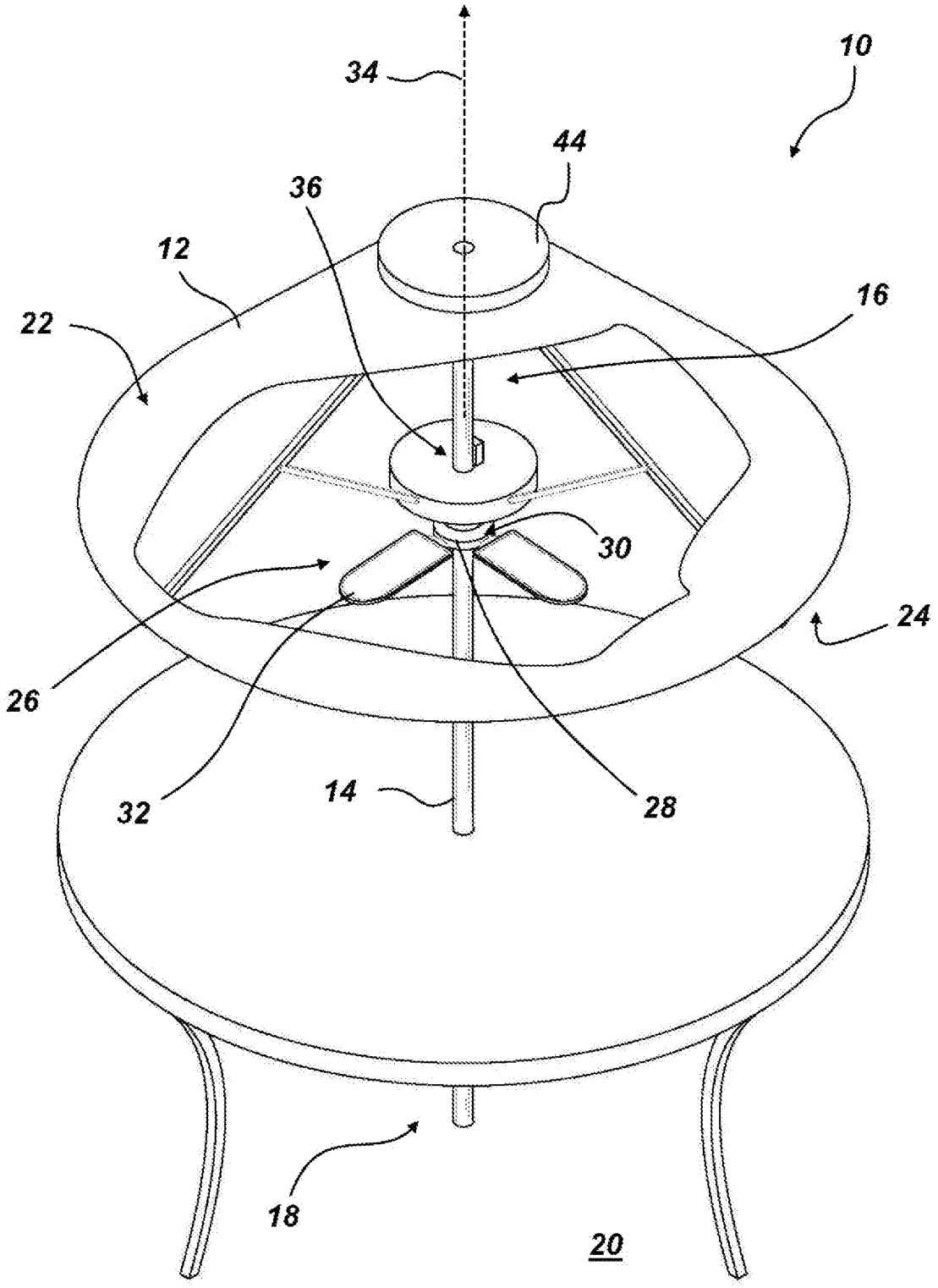
FIG. 1 is an elevated side perspective of one embodiment of an electronic assembly for a collapsible cover supported by a pole.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used in the claims, the definite article "said" identifies required elements that define the scope of embodiments of the claimed invention, whereas the definite article "the" merely identifies environmental elements that provide context for embodiments of the claimed invention that are not intended to be a limitation of any claim.

Referring now to the drawings, wherein identical numerals indicate the same elements throughout the figures, embodiments of the present invention include an electronic assembly 10 for a cover 12 supported by a pole 14 defining a top portion 16 associated with the cover 12 and an opposing bottom portion 18 configured to engage a support surface 20. The cover 12 may be collapsible/folding and any suitable cover material may be used, including canvas, wood, and metals. The cover 12 defines an outer surface 22 and an opposing inner surface 24. One embodiment of cover 12 supported by a pole 14 is a patio umbrella where the cover is made out of canvas material. The umbrella may or may not be associated with a table. For the current embodiment, the electronic assembly 10 comprises an electronic fan 26 defining a fan body 28 housing a motor configured for rotating a hub 30. The hub 30 may be mechanically associated with fan blades 32, and the body 28 may be movably associated with the pole 14. For example, the pole 14 may extend through the body 28 so that the body 28 may slide along the pole 14. For this embodiment, the hub 30 and associated fan blades 32, rotate about an axis 34 defined by the pole 14. A first latch point 36 may be provided where the electronic fan 26 engages the pole 14 so that the electronic fan 26 remains at the first latch point 36 until disengaged/folded up.

Figure 2:
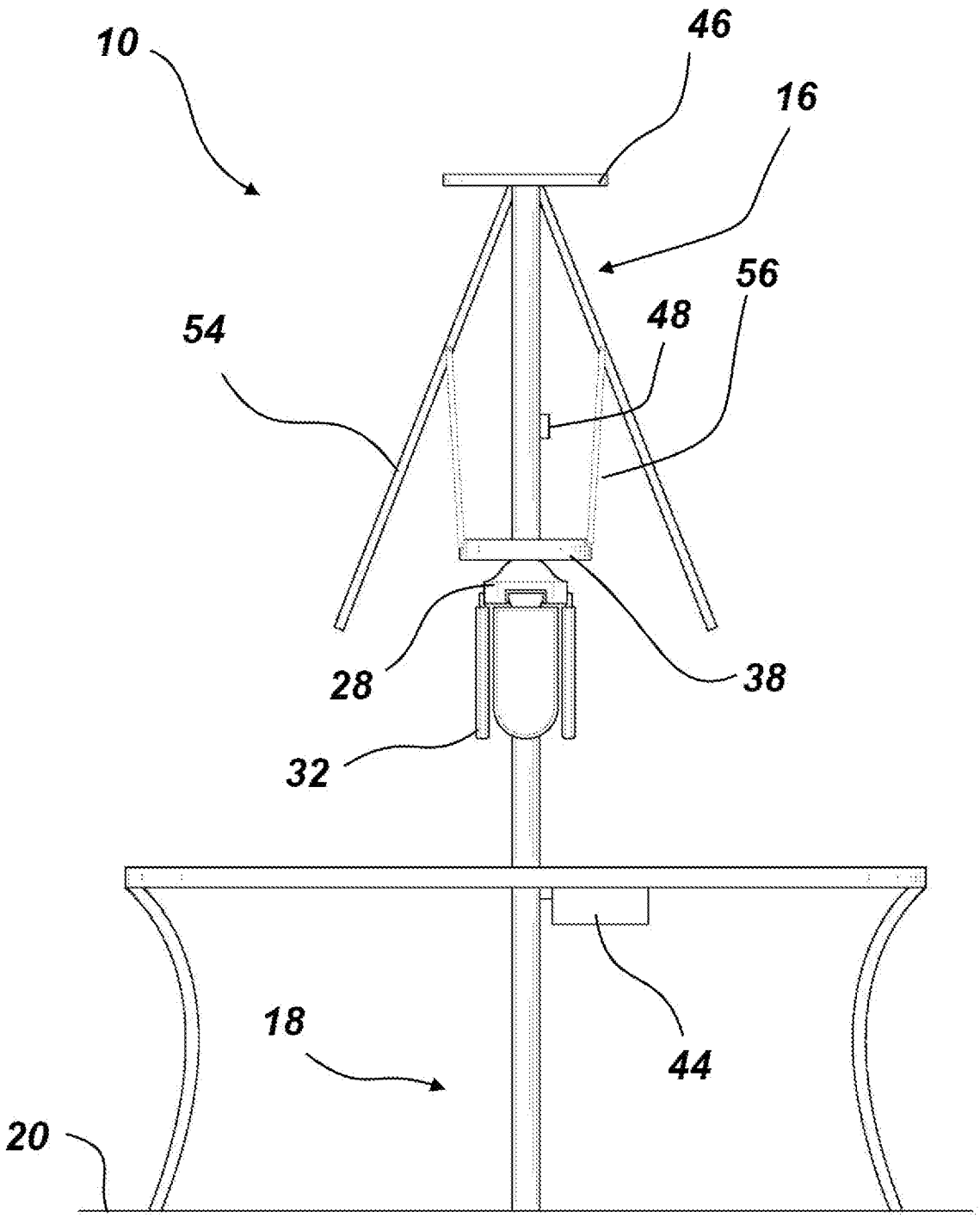
FIG. 2 is a side elevated view of a collapsible fan module associated with an interface associated with a pole where the interface is connected to support rails for a collapsible cover.
Figure 3:
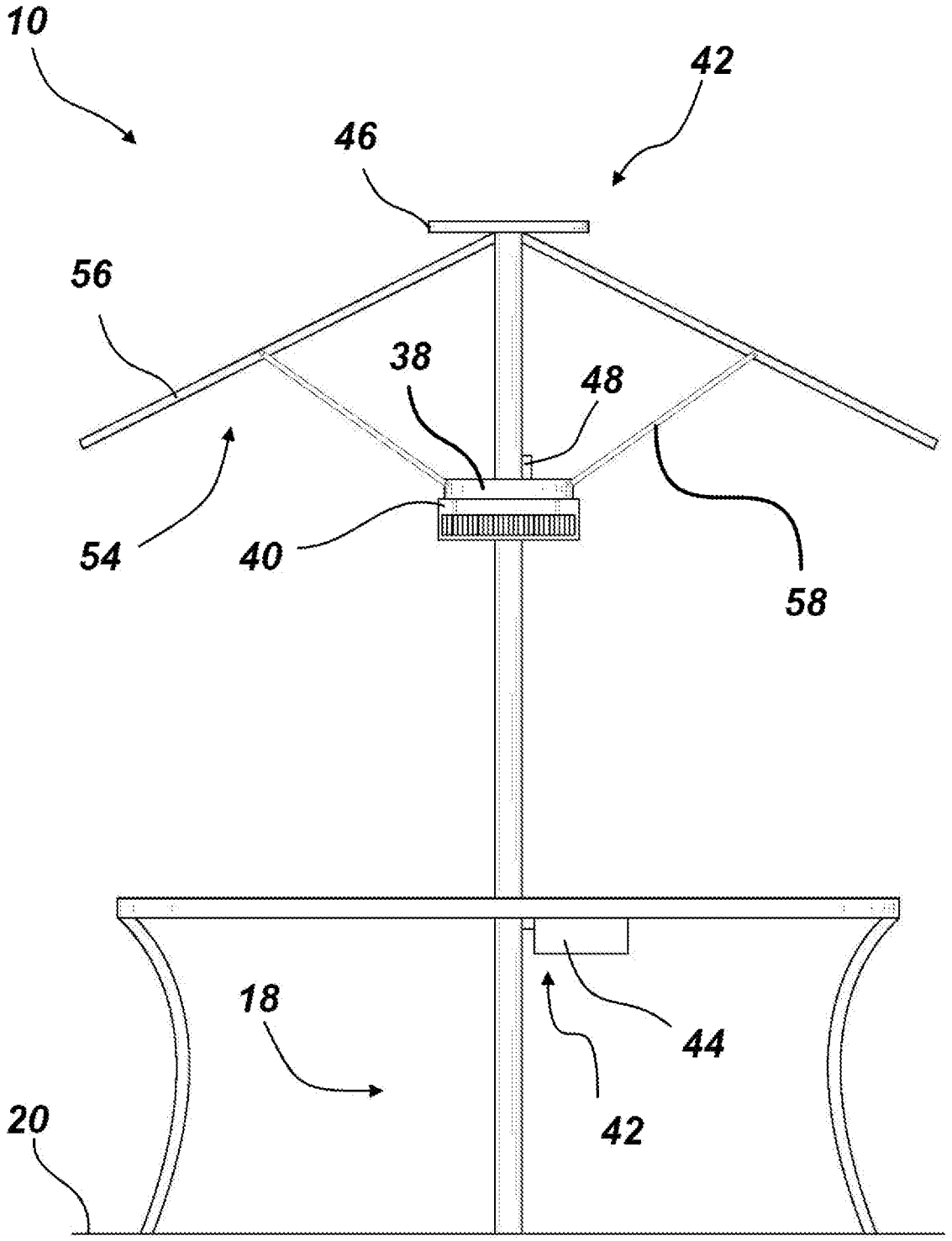
FIG. 3 is a side elevated view of a squirrel fan module replacing the collapsible fan module depicted in FIG. 2.
Figure 4:
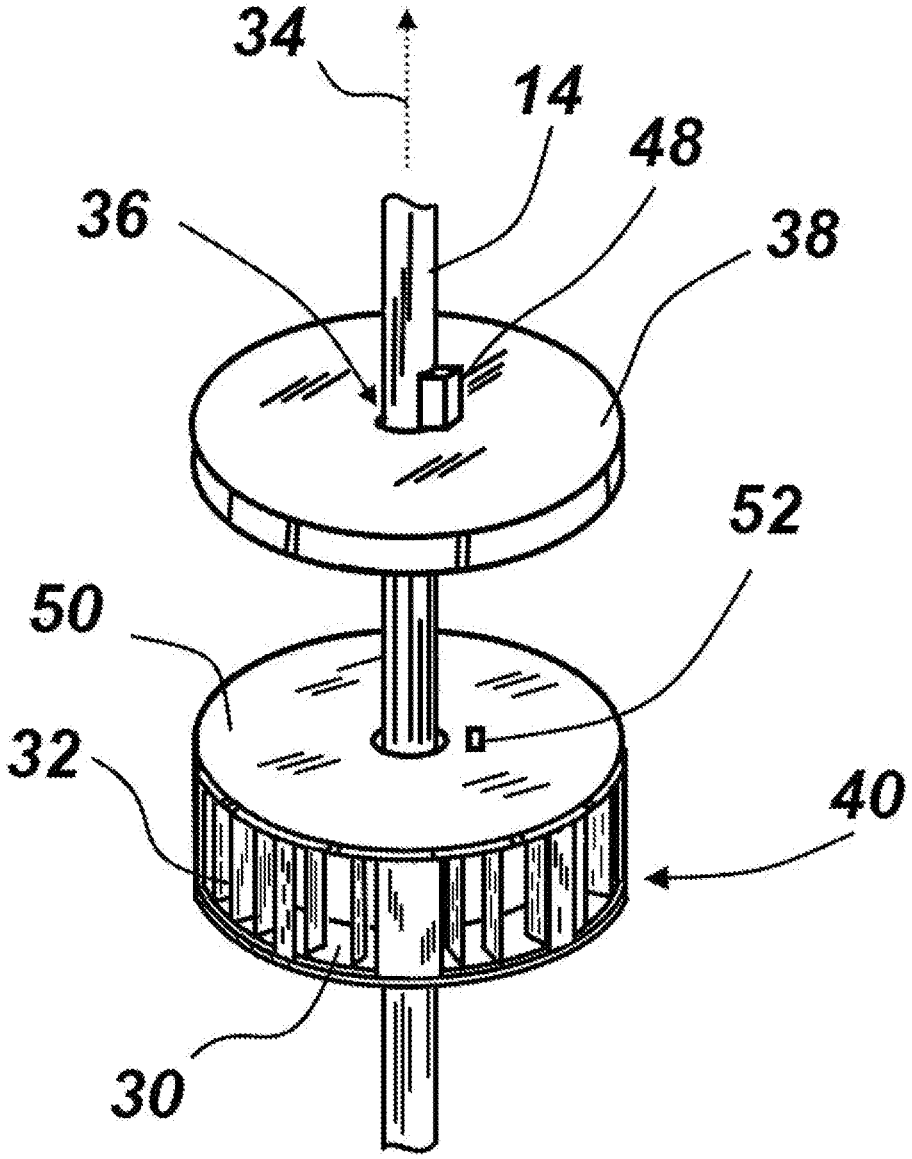
FIG. 4 is a close-up view of a squirrel fan module and interface associate with a pole.

As best seen in FIG. 2 and FIG. 3, for one alternative embodiment, the electronic assembly 10 includes an interface 38 associated with a pole 14 at a first latching point 36. The interface 38 may be intergraded into the electronic fan 26, or the interface may define a component configured to engage/receive electronic modules 40, as depicted in FIG. 4. In FIG. 4, for example, the electronic module 40 defines a squirrel fan.

A power source 42, which may include a power storage device 44 and/or a power generating device 46, may be electronically associated with and configured to supply power to the electronic assembly 10. For example, the power source 42 may supply power to the electronic fan 26 and/or the interface 38. Where there is a separate interface 38 (i.e. for configurations comprising modules), the power source 42 may supply power to the interface 38, which distributes the power as needed to the electronic assembly 10 components. Embodiments of a power storage device 44 include rechargeable batteries such as the batteries used by electric drills. Embodiments of a power generating device 46 include photovoltaic devices, wind-powered turbine devices, and energy harvesting devices such as RF scavengers. When the electronic assembly 10 comprises an electronic fan 26, the power source is configured to supply the power needed to rotate the hub 30.

A sensor 48 may be disposed at or adjacent to the first latch point 36 and may be configured to disable the electronic assembly 10, interface 38, and/or the electronic fan 26 when the sensor 48 does not sense the presence of an object at the first latch point 36. The particular sensor 48 for performing this function may be any suitable sensor technology including a reed switch, a photoelectric sensor, a magnetic field sensor, a proximity sensor, a simple mechanical switch or other sensors known to one of ordinary skill in the art for sensing the presence of one or more components. For one example, the electronic fan 26 is disabled when the sensor 48, disposed at or adjacent to the first latch point 36, does not sense the presence of body 28. For configurations comprising a separate interface 38 that is not stationary, the sensor 48 may be configured to sense the presence of interface 38. Alternatively, as depicted in FIG. 4, the interface 38 may comprise a sensor (not shown), which may be configured to detect the engagement of a module surface 50 with the interface 38. For example, a photoelectric sensor associated with interface 38 may be configured to detect a trigger 52 (which may be a reflective surface) defined at/by/on the module surface 50 when the module surface 50 is engaging the interface 38 and trigger 52 is adjacent to the photoelectric sensor. The term "trigger" simply refers to something that "triggers" a sensor is some way. For one embodiment, the electronic fan 26 may be disabled when either of the interface 38 is not detected at first latching point 36 or the module surface 50 is not engaging a surface of interface 38.

Attention is now directed more specifically to the electronic fan 26 described above. For one embodiment, fan blades 32 are mechanically associated with the hub 30 at one end and extend away from the hub 30, much like a traditional ceiling fan. Alternatively, such fan blades may be configured like a propeller and secured to the hub 30 in the middle of the fan blade. Any suitable fan technology and configuration may be used. Unlike traditional fans, however, and as depicted in FIG. 2, for one embodiment the fan blades 32 are configured to collapse toward the bottom portion 18 to a more parallel position with pole 14 (and axis 34) when the hub 30 is not rotating fast enough to create the centripetal force required to support the weight of the fan blades 32. Similarly, for one embodiment, the fan blades 32 automatically extend from the collapsed position to an extended position (e.g. a position more perpendicular with pole 14 and the axis 34) when the hub 30 is rotating and generating enough centripetal force to cause the fan blades 32 to extend. For one alternative embodiment, the fan blades 32 may be manually extended where they releasably latch in place. For such a configuration, the fan blades 32 may be manually collapsed as well. Additionally, for one embodiment, the fan blades may define an adjustable lighting feature where the direction of the light may be adjusted by adjusting the position of the fan blades when the fan blades are not rotating. When the fan is rotating, the light emitted by the lighting feature may indicate a speed at which the hub and/or fan blades are rotating.

As best seen in FIG. 2 and FIG. 3, attention is now directed to embodiments of the invention where the cover 12 is collapsible and is associated with cover support structure 54. The support structure may comprise support rails 56 that engage the cover and connecting arms 58 that associate the support rails 56 with the electronic fan 26 or interface 38, depending on the configuration of the system. For this embodiment, the electronic fan 26 is configured to slide along pole 14 as described above where the "umbrella" is configured to extend as the electronic fan 26 moves toward the top portion 16 and collapse as the electronic fan 26 moves toward the bottom portion 18. Notably, if the electronic fan 26 is not already off when the electronic fan 26 is moved toward the bottom portion 18, the sensor 48 detects the absence of the electronic fan 26 and disables the electronic fan 26 (i.e. turns it off) and the fan blades 32 collapses toward the bottom portion 18. Such is one method of transitioning the system between the deployed and the retracted/storage/unused state. Similarly, when the electronic fan 26 is moved from the storage configuration toward the upper portion 16 so that the electronic fan 26 engages the first latching position 36, the cover also extends to the deployed position. Additionally, the fan blades 32 may automatically extend as the electronic fan 26 moves toward the upper portion 16 or the fan blades 26 may be manually extended or the fan blades 32 may automatically extend when the electronic fan 26 is turned on and starts generating the force needed to extend the fan blades 32 as described above.

Figure 5:
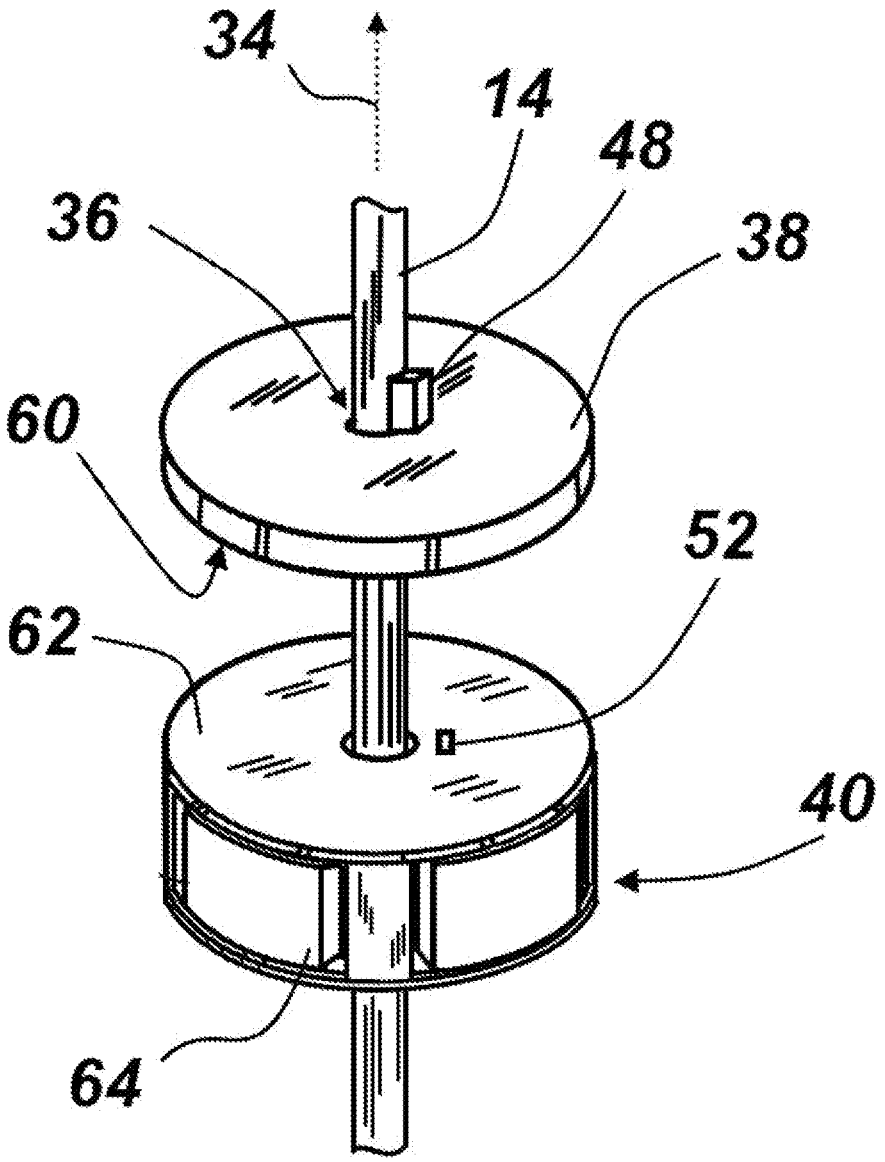
FIG. 5 is a close-up view of an electronic module defining secured storage pods.

Attention is now directed to the embodiments comprising electronic modules 40. As best seen in FIG. 4 and FIG. 5, for one embodiment of the invention, the electronic fan assembly 10 further includes an interface 38 associated with the pole 14 at the first latching point 36. The interface 38 is depicted as having a solid disc-shaped body. It should be appreciated that such interface 38 may take any suitable shape and may define a wire type body. Similar to the electronic fan 26 configuration described above, the interface 38 may be configured to movably engage the pole 14 at a first latching point 36. Further, for the embodiment depicted in FIG. 5, the interface 38 defines an interface surface 60 configured to releasably engage an electronic module 40. Any suitable method may be used to engage the electronic module 40 with interface 38 including snaps, clips, and magnetic coupling. The electronic model 40 may be a collapsible fan module based on the electronic fan 26 previously described, a squirrel fan module such as the one depicted in FIG. 4 and a personality module such as the one depicted in FIG. 5.

As noted above, a personality module is simply a module that helps establish the "personality" of the electronic assembly 10. The personality module depicted in FIG. 5 is a storage module 40 comprising secure storage pods 64. For example, for electronic assembly 10 systems associated with beach umbrella's, the electronic fan 26 may not be needed as beaches are generally windy. However, one often needs shade and secure storage to store a smartphone and money, etc. while going swimming. For this use of the invention, the electronic module 40 may define a security system comprising storage pods 64 that allows a person to store objects (e.g. phone, keys, wallet, etc.) while swimming. The associated interface 38 may include communication technology that is configured to receive signals from a remote device such as a pod transmitter or a smartphone to secure and/or unlock the pod 64. Such pod transmitters may be stored in the pod, for example, when not being used. A person wishing to store something may use a smartphone and communicate with the system over a network to enable the system (and pay for its use). If such a person is not storing the same smartphone, such a smartphone can be used to control the pod 64. Otherwise, the pod transmitter may be removed from the pod 64 by the user. Such a user would then use the pod transmitter to lock and/or unlock the pod 64. The pod transmitter may also be configured to activate a signaling device defined by the electronic system 10 to help a user locate his/her umbrella, which may be useful when there is a beach full of umbrellas or someone is trying to walk off with an umbrella. Similarly, the interface 38 may be configured to signal the pod transmitter or smartphone when the interface's 38 location is changing or some other predefined movement is detected.

As before, at least one sensor 48 may be configured to detect when the interface 38 is positioned at the first latch point 36. Similarly, a sensor may be used to detect when the module 40 is engaging the interface 38 as described above. Where the electronic module 40 defines a fan module, the electronic module 40 may be disabled by sensor 48 according to predefined fan/module criteria. Such predefined fan criteria may include (a) disabling the electronic fan 26 when not engaging interface 38, (b) disabling the electronic fan 26 when the interface 38 is not engaging the first latch point 36, or (c) disabling the interface 38 when the interface is not engaging with first latch point 36.

Figure 6:
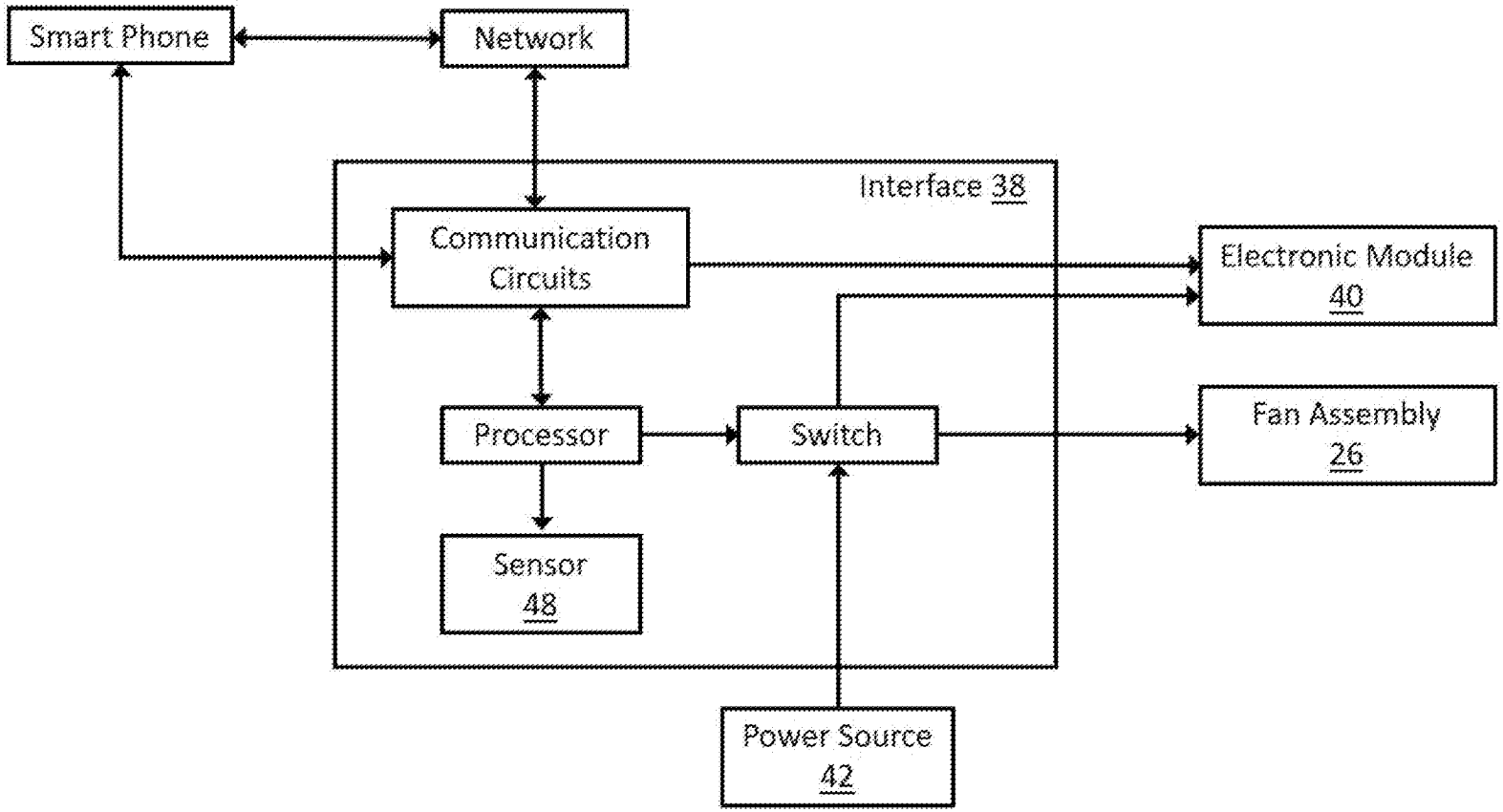
FIG. 6 is a block diagram representation of one embodiment of the electrical features of an electronic assembly and interface.

While the simplest version of the electronic assembly 10 may comprise only mechanical switches and sensors, some embodiments comprise digital technologies. Referring now to FIG. 6, a block diagram illustration of one embodiment of the electronic assembly 10 digital electronic features are considered. As noted above, the electronic assembly 10 is powered by a power source 42. The power source 42 may be power storage device 44, such as a battery or a power generating device 46, such as a photovoltaic device. The fan assembly 26, electronic modules 40 and the power source 42 are selected to be compatible with each other, and such technologies are well known in the art and are not discussed in detail. The operation of electronic assembly 10 may be controlled by interface 38, which may be an integral component of an electronic fan 26 assembly or a separate component, as represented in FIG. 6. The controller may comprise a processor electrically associated with a switch that controls power flow from power source 42 to system components. If sensor 48 signals to disable a feature, such as the fan assembly 26, the processor executes a first logic that causes the switch to remove power from the appropriate device, for this example, the fan assembly 26.

For embodiments comprising digital electronics, such as a processor as depicted in FIG. 6, such processor may define a microprocessor or similar technology. The electronic assembly 10 electronic hardware may comprise standard components known in the art, although such hardware configuration and control routines are novel. The processor may support standard operating systems and application software as well as ASICs (application specific integrated circuit) or ASSPs (application-specific standard product) or a PIC (programmable Intelligent Computer). The processor may comprise onboard ROM, RAM, EPROM type memories for storing data and/or program code such as firmware. The processor may be further associated with off-chip memory including remote storage such as cloud storage. For one embodiment, processor comprises a DSP/ASSP (not shown) configured to perform signal processing tasks such as voice, audio, video, encoding, decoding as well as other data and signal processing functions. Such allows a video sensor, for example, to record images and sound as well as generate the same.

For configurations comprising communication technology, such technology may define a transmitter and/or a transceiver configured to transmit a data signal to a remote device such as a smartphone, WiDi enabled display, remoter computer. Embodiments of suitable communication technologies include custom designs as well as WiFi and Bluetooth transceivers, GPRS, GSM, GPRS, 3G, 4G, 5G and EDGE enabled networks as well as WAP networks. Such communications may take the form of SMS and e-mail messages.

One of ordinary skill in the art will recognize that the inherent flexibility of computer-based systems allows for a great variety of possible configurations, combinations, and divisions of tasks and functionality between and among components. For instance, methods discussed herein may be implemented using a single server or multiple servers working in combination. Similarly, databases and logic for manipulating the databases may be implemented on a single system or distributed across multiple systems sequentially or in parallel. Data transferred between components may travel directly or indirectly.

The various computer systems discussed herein are not limited to any particular hardware architecture or configuration. Embodiments of the methods and systems set forth herein may be implemented by one or more general-purpose or customized computing devices adapted in any suitable manner to provide the desired functionality. The device(s) may be adapted to provide additional functionality complementary or unrelated to the present subject matter, as well. For instance, one or more computing devices may be adapted to provide desired functionality by accessing logic or software instructions rendered in a computer-readable form. When software is used, any suitable programming, scripting, or another type of language or combinations of languages may be used to implement the teachings contained herein. However, software need not be used exclusively, or at all. For example, some embodiments of the systems and methods set forth herein may also be implemented by hard-wired logic or other circuitry, including, but not limited to application-specific circuits. Of course, combinations of computer-executed software and hard-wired logic or other circuitry may be suitable, as well.

Embodiments of the systems and methods disclosed herein may be executed by one or more suitable computing devices. Such system(s) may comprise one or more computing devices adapted to perform one or more embodiments of the methods disclosed herein. As noted above, such devices may access one or more computer-readable media that embody computer-readable instructions which, when executed by at least one computer, cause the computer(s) to implement one or more embodiments of the methods of the present subject matter. Additionally, or alternatively, the computing device(s) may comprise circuitry that renders the device(s) operative to implement one or more of the methods of the present subject matter. Furthermore, components of the presently disclosed technology may be implemented using one or more computer-readable media. Any suitable computer-readable medium or media may be used to implement or practice the presently-disclosed subject matter, including, but not limited to, diskettes, drives, and other magnetic-based storage media, optical storage media, including disks (including CD-ROMs, DVD-ROMs, and variants thereof), flash, RAM, ROM, and other memory devices, and the like.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An electronic assembly for a cover supported by a pole, said electronic assembly comprising:

an electronic fan comprising a fan body housing a motor configured for rotating a hub mechanically associated with fan blades wherein said body is movably associated with a pole that extends through said body so that said body can slide along the pole and wherein the pole defines a top portion associated with a cover and an opposing bottom portion configured to engage a support surface wherein the cover defines an outer surface, and an opposing inner surface and wherein said hub rotates about an axis defined by the pole and wherein said electronic fan further engages the pole at a first latch point;

a power source electronically associated with said electronic fan;

a sensor disposed at or adjacent to said first latch point and wherein said electronic fan is disabled when said sensor does not sense the presence of said body; and wherein said fan blades are configured to collapse toward the bottom portion when said hub is not rotating.

2. An electronic assembly for a cover supported by a pole as in claim 1, wherein said fan blades are configured to be manually extended.

3. An electronic assembly for a cover supported by pole as in claim 1, wherein said fan blades automatically extend when said hub is rotating at or above a predefined speed and automatically collapse as said hub stops rotating.

4. An electronic assembly for a cover supported by a pole as in claim 3, wherein said electronic fan is mechanically associated with the cover so that the cover extends as said electronic fan moves toward the top portion and the cover retracts as said electronic fan moves toward the bottom portion.

5. An electronic assembly for a cover supported by pole as in claim 4, wherein said power source is one of a power storage device or a power generating device.

6. An electronic assembly for a cover supported by a pole as in claim 1, wherein said power source is a battery and said electronic assembly further comprising a photovoltaic device electronically associated with at least one of said electronic fan and said battery.

7. An electronic assembly for a cover supported by a pole as in claim 1, wherein the cover and the pole define a patio umbrella and wherein the first latching point is positioned at least six feet above the support surface.

8. An electronic assembly for a cover supported by a pole as in claim 1, wherein the configuration of said fan blades and the speed at which said hub rotates is selected to generate a volume of air displacement that repels insects within a predefined zone below the fan blades and wherein said predefined zone defines an airflow band under the perimeter of the umbrella.

9. An electronic assembly for a collapsible umbrella supported by a pole, said electronic assembly comprising:

an electronic fan comprising a fan body housing a motor configured for rotating a hub mechanically associated with fan blades wherein said body is movably associated with a pole that extends through said body so that said body can slide along the pole and wherein the pole defines a top portion associated with a collapsible cover and an opposing bottom portion configured to engage a support surface and wherein said hub rotates about an axis defined by the pole and wherein said electronic fan further engages the pole at a first latch point;

a power source electronically associated with said motor;

a sensor disposed at or adjacent to the first latch point and wherein said motor is disabled when said sensor does not sense the presence of said body; and wherein said fan blades are configured to collapse.

10. An electronic assembly for a collapsible umbrella supported by a pole as in claim 9, wherein said fan blades are configured to be manually extended.

11. An electronic assembly for a collapsible umbrella supported by a pole as in claim 9, wherein said fan blades automatically extended when the hub is rotating at or above a predefined speed and automatically collapse as the hub stops rotating.

12. An electronic assembly for a collapsible umbrella supported by a pole as in claim 11, wherein the cover is mechanically associated with said electronic fan by a support structure and wherein the cover is configured to extend as said electronic fan moves toward the top portion and collapse as said electronic fan moves toward the bottom portion.

13. An electronic assembly for a collapsible umbrella supported by a pole as in claim 12, wherein said body is configured to slide along the pole far enough to engage a latching point positioned at least six feet above the support surface.

* * * * *